US006017240A

United States Patent [19]

Belopolsky et al.

[11] Patent Number: 6,017,240

[45] Date of Patent: Jan. 25, 2000

[54] MODULAR PLUG HAVING LOW ELECTRICAL CROSS TALK AND METALLIC CONTACT FOR USE THEREIN

[75] Inventors: Yakov Belopolsky, Harrisburg; Robert M. Solomon, Etters, both of Pa.

[73] Assignee: Berg Technology, Inc., Reno, Nev.

[21] Appl. No.: 09/119,915

[22] Filed: Jul. 21, 1998

[51] Int. Cl.[7] ..... H01R 4/24

[52] U.S. Cl. ..... 439/418; 439/941

[58] Field of Search ..... 439/418, 676, 439/941

[56] References Cited

U.S. PATENT DOCUMENTS

| | | | |
|---|---|---|---|
| 4,054,350 | 10/1977 | Hardesty | 439/418 |
| 4,148,539 | 4/1979 | Hardesty | 339/97 R |
| 4,160,575 | 7/1979 | Schraut | 339/103 M |
| 4,193,658 | 3/1980 | Dittmann et al. | 339/97 P |
| 4,211,462 | 7/1980 | Wolfthal | 339/103 M |
| 4,412,715 | 11/1983 | Bogese | 339/97 P |
| 4,607,905 | 8/1986 | Vaden | 339/176 M |
| 4,613,196 | 9/1986 | Goerster | 339/97 P |
| 4,650,269 | 3/1987 | Denkmann et al. | 439/418 |
| 4,679,878 | 7/1987 | Volk | 439/425 |
| 4,679,879 | 7/1987 | Triner et al. | 439/676 |
| 4,715,825 | 12/1987 | Mouissie et al. | 439/391 |
| 4,874,330 | 10/1989 | Bogese, II et al. | 439/418 |
| 4,909,755 | 3/1990 | Chen | 439/418 |
| 4,950,176 | 8/1990 | Cocco et al. | 439/344 |
| 5,246,381 | 9/1993 | Tashiro et al. | 439/395 |
| 5,284,447 | 2/1994 | Kristiansen | 439/425 |
| 5,299,956 | 4/1994 | Brownell et al. | 439/638 |
| 5,309,630 | 5/1994 | Brunker et al. | 29/842 |
| 5,425,658 | 6/1995 | White | 439/637 |
| 5,556,296 | 9/1996 | Dussausse et al. | 439/404 |
| 5,571,035 | 11/1996 | Ferrill | 439/894 |
| 5,593,314 | 1/1997 | Lincoln | 439/418 |

*Primary Examiner*—Neil Abrams
*Assistant Examiner*—Javaid Nasri
*Attorney, Agent, or Firm*—Brian J. Hamilla; Daniel J. Long; M. Richard Page

[57] ABSTRACT

A modular plug having an insulative housing comprising a front wall, a rear wall, a top wall, a bottom wall and a pair of lateral walls perpendicularly interposed between the top two bottom walls. There are a number of longitudinal terminal receiving slots in the front and top wall. There is a cable receiving cavity in the rear wall. A number of conductors means extend from the rear wall of the jack to adjacent to a different one of the said pin receiving slots. There are also a number of metallic contacts, and each of the contacts is adjacent to a different one of the terminal receiving slots and is connected to a different one of the conductors. At least one of the contacts has a different shape from at least one of the other contacts. A surprising and unexpected reduction in cross talk is achieved.

17 Claims, 6 Drawing Sheets

MODULAR PLUG HAVING LOW ELECTRICAL CROSS TALK AND METALLIC CONTACT FOR USE THEREIN

BACKGROUND OF THE INVENTION

1. Field of the Invention

The present invention relates to electrical connectors and more particularly to modular plugs for use in telecommunications equipment.

2. Brief Description of Prior Developments

Telephone-style modular plugs and jacks are well known. They are used extensively in the telephone and communications industries, and for general interconnect purposes. The modular plugs of the prior art typically utilize a plurality of side-by-side, substantially planar contact terminals to terminate a corresponding plurality of insulated wires.

Modular plugs are used in two broad categories of signal transmission; analog (voice) and digital (data) transmission. These categories can overlap somewhat since digital systems are used for voice transmission as well. Nevertheless, there is a significant difference in the amount of data transmitted by a system per second. A low speed system would ordinarily transmit from about 10 to 16 megabites per second (Mbps) while a high speed system should be able to handle 155 Mbps or even higher data transfer speeds. Often high speed installations are based on asynchronous transfer mode transmission and utilize shielded and unshielded twisted pair cables.

With recent increases in the speed of data transmission requirements have become important for electrical connectors. In particular, with regard to the reduction or elimination of crosstalk. Crosstalk is a phenomena in which a part of the electromagnetic energy transmitted through one of multiple conductors in a connector causes electrical currents in the other conductors.

Another factor which must be considered is that the telecommunications industry has reached a high degree of standardization in modular jack design. Outlines and contact areas are essentially fixed and have to be interchangeable with other designs. It is, therefore, important that any novel modular jack allow with only minor modification the use of conventional parts or tooling in its production.

There is, therefore, a need for a modular plug which will reduce or eliminate crosstalk in telecommunications equipment.

There is also a need for such a modular plug which can reduce or eliminate crosstalk and common mode interference which is interchangeable with prior art modular jacks and which may be manufactured using conventional parts and tooling.

SUMMARY OF THE INVENTION

The invention is a modular plug having an insulative housing comprising a front wall, a rear wall, a top wall, a bottom wall and a pair of lateral walls perpendicularly interposed between the top two bottom walls. There are a number of longitudinal terminal receiving slots in the front and top wall. There is a cable receiving cavity in the rear wall. A number of conductors means extend from the rear wall of the jack to adjacent to a different one of the said pin receiving slots. There are also a number of metallic contacts, and each of the contacts is adjacent to a different one of the terminal receiving slots and is connected to a different one of the conductors. At least one of the contacts has a different shape from at least one of the other contacts.

Also encompassed by the present invention is a metallic contact which is a metallic contact which is a substantially planar blade which is asymmetrical relative to its vertical centerline. The contact has an upper portion, a middle portion and a lower portion, and the width of the upper portion is greater than the middle section, and the lower section has a pair of conductor engaging tangs.

BRIEF DESCRIPTION OF THE DRAWINGS

The present invention is further described with reference to the accompanying drawings in which:

FIGS. 7A-1 and FIG. 7A-2 are top plan views of two asymmetrical metallic contacts which may be used in the modular plug shown in FIGS. 1–6;

FIGS. 7B-1 and 7B-2 are top plan views of alternate asymmetrical metallic contacts which may be used in FIGS. 1–6; and FIGS. 7C-1 and 7C-2 are top plan views of symmetrical metallic contacts which may be used in the modular plugs shown in FIGS. 1–6.

DETAILED DESCRIPTION OF THE PREFERRED EMBODIMENTS

Figure 4:
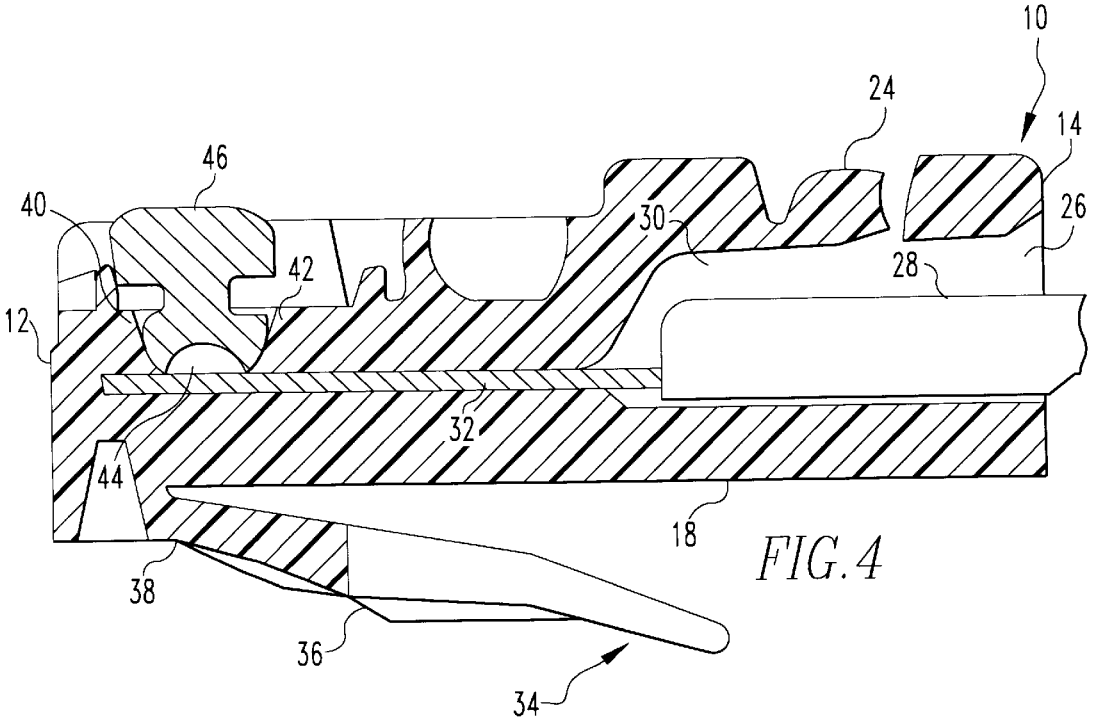
FIG. 4 is a cross sectional view through 4—4 in FIG. 1.
Figure 5:
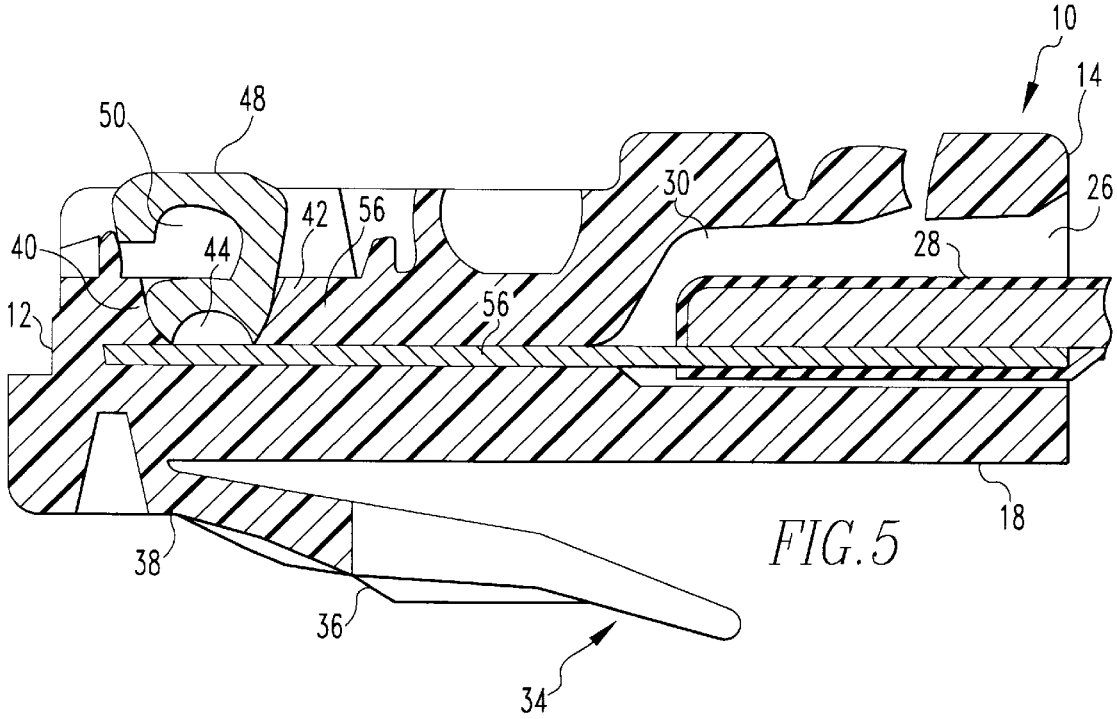
FIG. 5 is a cross sectional view through 5—5 in FIG. 1.
Figure 6:
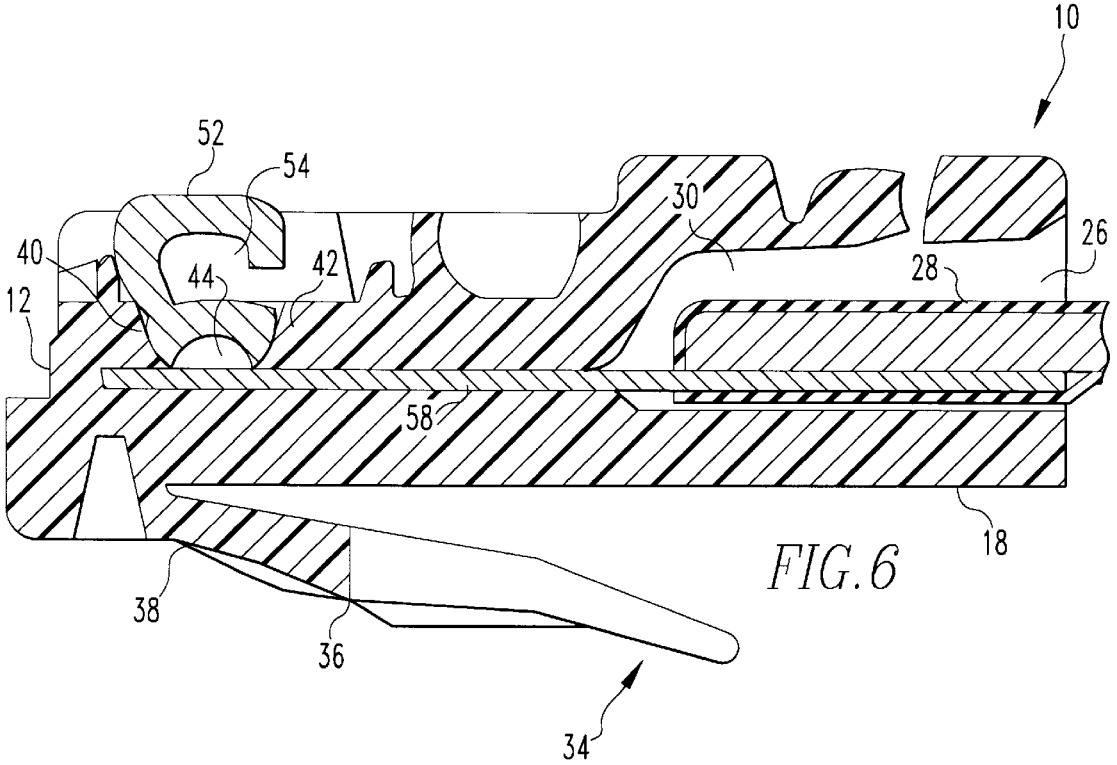
FIG. 6 is a cross sectional view through 6—6 in FIG. 1.

Referring to FIGS. 1–6, the modular plug includes an insulative housing shown generally at numeral 10. This insulative housing includes a front wall 12, a rear wall 14, a top wall 16 and a bottom wall 18. Interposed between the top and bottom wall there are lateral walls 20 and 22. Extending between the front wall 12 and the top wall 16 there are a plurality of longitudinal slots at positions 1, 2, 3, 4, 5, 6, 7 and 8. On the top wall 16 there is a snap lock 24. On the rear wall 14 there is a cable receiving opening 26 for receiving a cable 28. A cable and wire conveying cavity 30 conveys 8 insulated electrical wires as at wire 32 from the cable to a point adjacent each of the slots. The plug also has a latching arm 34 which a base shoulder 36 and a pivot point 38 to allow movement of the latching arm during engagement with a jack. Beneath the slots there are also internal ledges 40 and 42, an interposed between these ledges there is a contact receiving cavity 44. A metallic contact is positioned beneath each slot in this cavity. These contacts have a variety of shapes and they can also be of different sizes. Referring particularly to FIG. 4, there is a substantially symmetrical contact 46 in slot 1. Referring particularly to FIG. 5, there is an asymmetrical contact 48 having a front, rearwardly extending recess 50 in the slot of position 3. Referring particularly to FIG. 6, there is another asymmetrical contact 52 with a rear, forwardly extending recess 54 is positioned beneath the slot in position 5. Asymmetrical contacts 48 and 52 are connected respectively to wires 56 and 58 by means of tangs in their lower portion which penetrate the insulation of these wires as will be explained hereafter.

Figure 1:
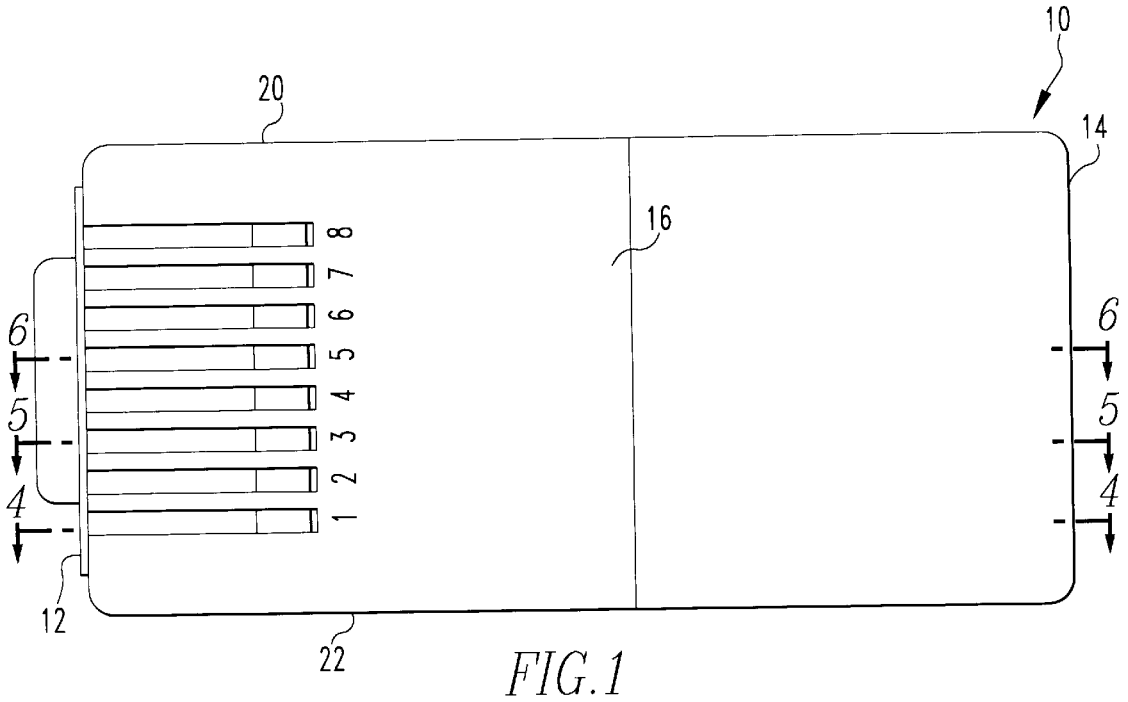
FIG. 1 is a top plan view of a preferred embodiment of the modular plug of the present invention.
Figures 1, 7A:
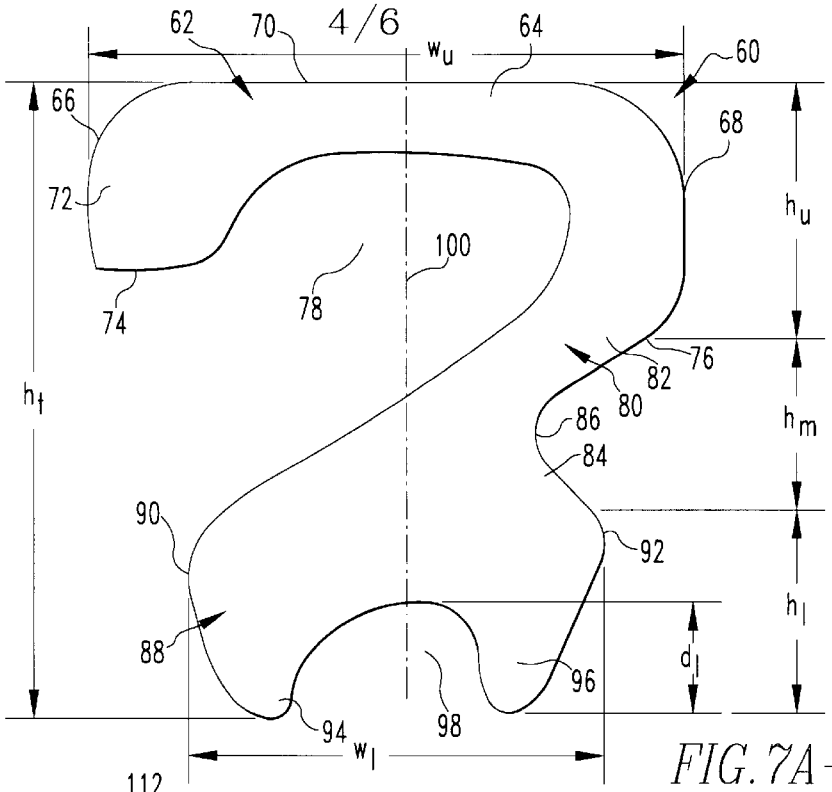
Figures 2, 7A:
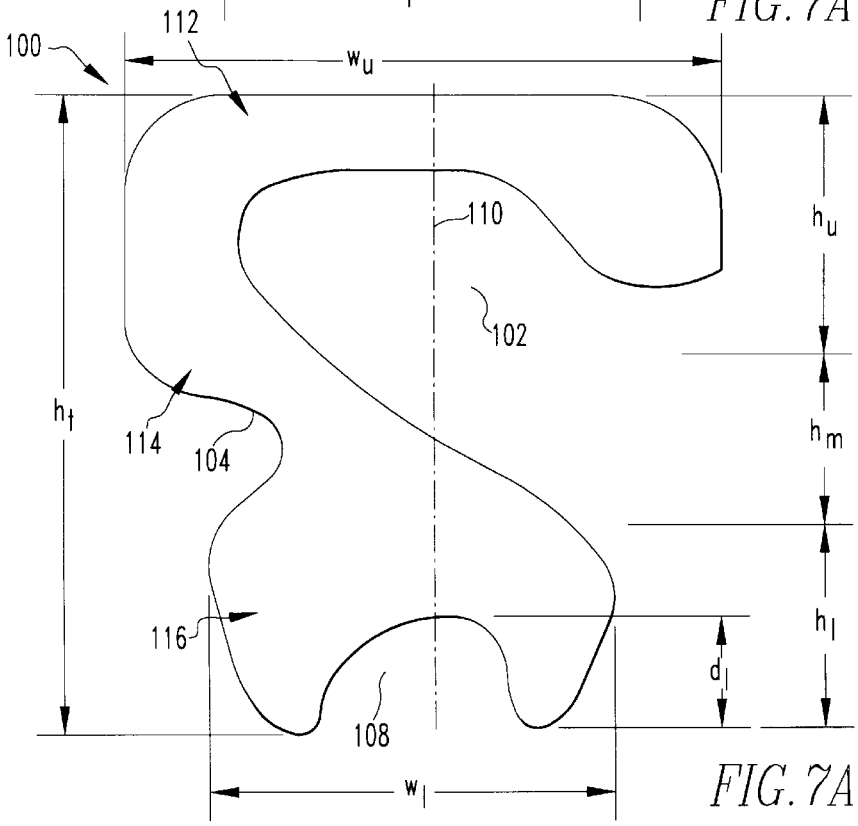

Referring to FIG. 7A-1, an asymmetrical contact which may be used in the above described plug is shown generally at numeral 60. This contact is comprised of a substantial by planar metal blade which has an upper body portion 62. This upper body portion has a horizontal section 64 with a forward end 66 and a rearward end 68. The upper portion also has a top surface 70 and a forward vertical section which has a base 74. In opposed relation to the base 74 there is an upper shoulder 76, and the base 74 and upper shoulder 76 served to support the contact on the ledges 40 and 42 (FIGS. 5–6). Beneath the upper body portion 62 there is a major front recess 78. Beneath the upper shoulder 76 there is a middle body section 80 which has an upper leg 82 and a lower leg 84. These legs intersect to form a minor rear recess 86. A lower body portion is shown generally at numeral 88. This lower body portion includes lower opposed and lower shoulders 90 and 92 which define the width of this body portion. The lower body portion 88 also includes two lower tangs 94 and 96 which serve to pierce the insulation of a wire to allow connection with the wire. Between these tangs there is a lower recess 98. The contact 60 also has a vertical center line 100, and it will be appreciated that the contact is asymmetrical relative to this center line. The contact also has a number of dimensions which will be referred to hereafter. Referring again to FIG. 7A-1, these relevant dimensions are an overall height $h_t$ and upper width $w_u$,a lower $w_l$ a gap of the lower recess $d_l$ a height of the upper body portion $h_u$, a height of the middle body portion $h_m$, a height of the middle body portion $h_m$ and a height of the lower body portion $h_l$.

Figure 2:
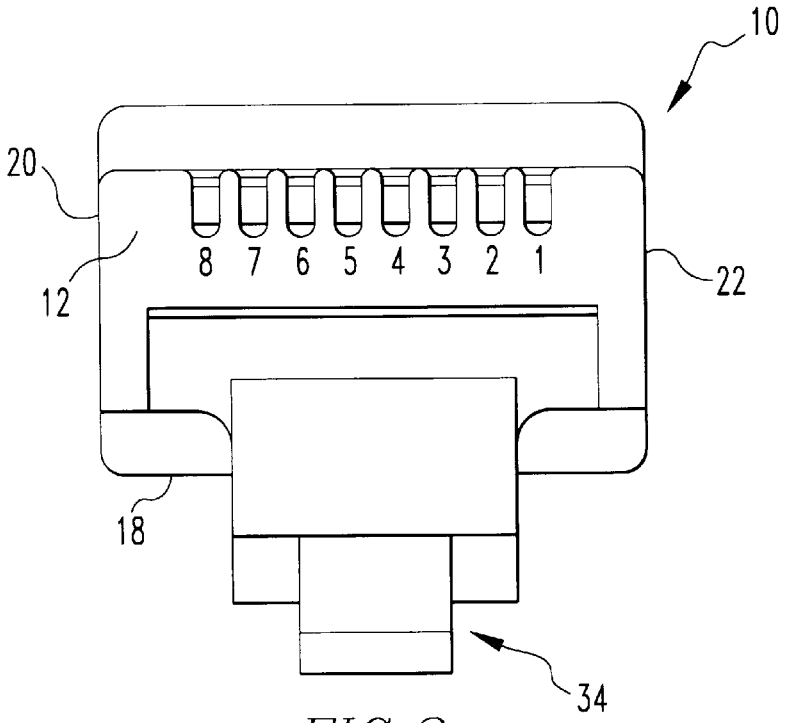
FIG. 2 is a front elevational view of the modular plug shown in FIG.
Figure 3:
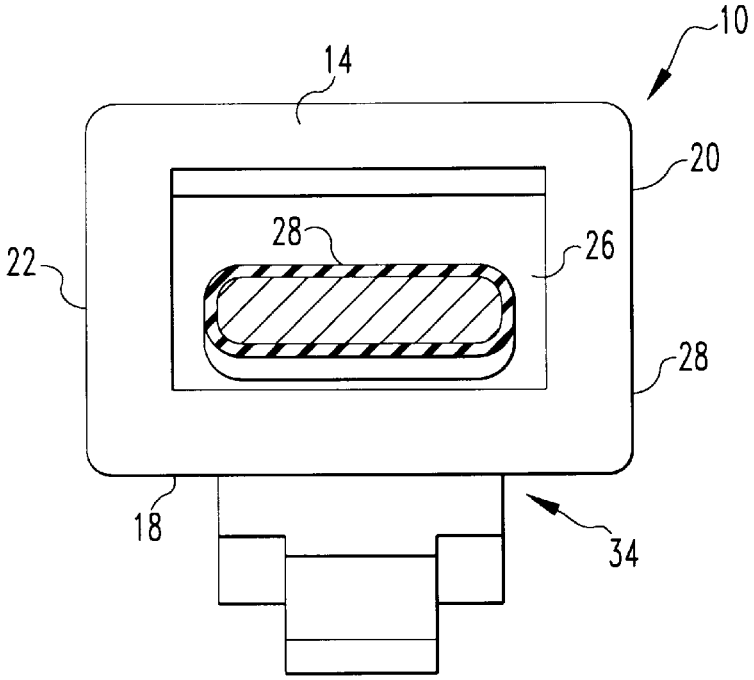
FIG. 3 is a rear elevational view of the modular plug shown in FIG. 1

Referring to FIG. 7A-2, another asymmetrical contact is shown generally at numeral 102. It will be appreciated that this contact is essentially the mere image of contact 60 (FIG. 7A-1) and is otherwise essentially identical. That is, the major recess in contact 102 is a major rear recess 104 and there is a minor front recess 106. There is also a lower recess 108. The contact 102 has a vertical center line 110, and it will be seen that the contact is asymmetrical relative to this center line. The upper body portion 112, the middle body portion 114 and the lower body portion 116 are essentially identical to their corresponding parts in contact 60. Contact 102 also has similar dimensions $h_t$, $w_u$, $w_i$, $h_u$, $h_m$, $h_l$ and $d_l$ has or described relative to contacts 60.

Figures 1, 7B:
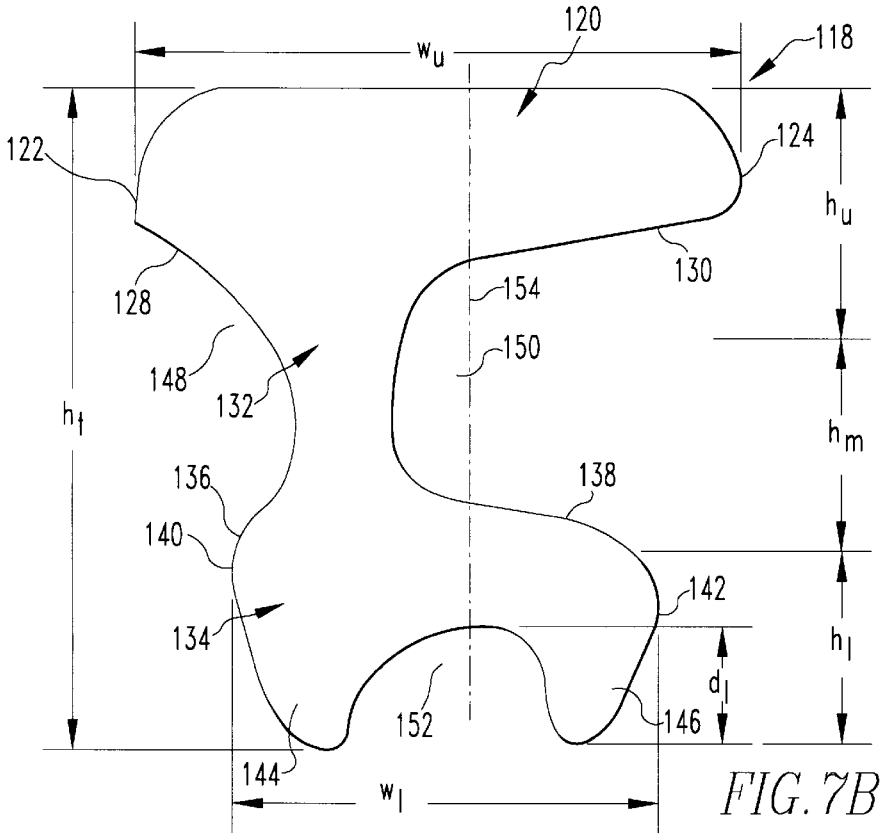
Figures 2, 7B:
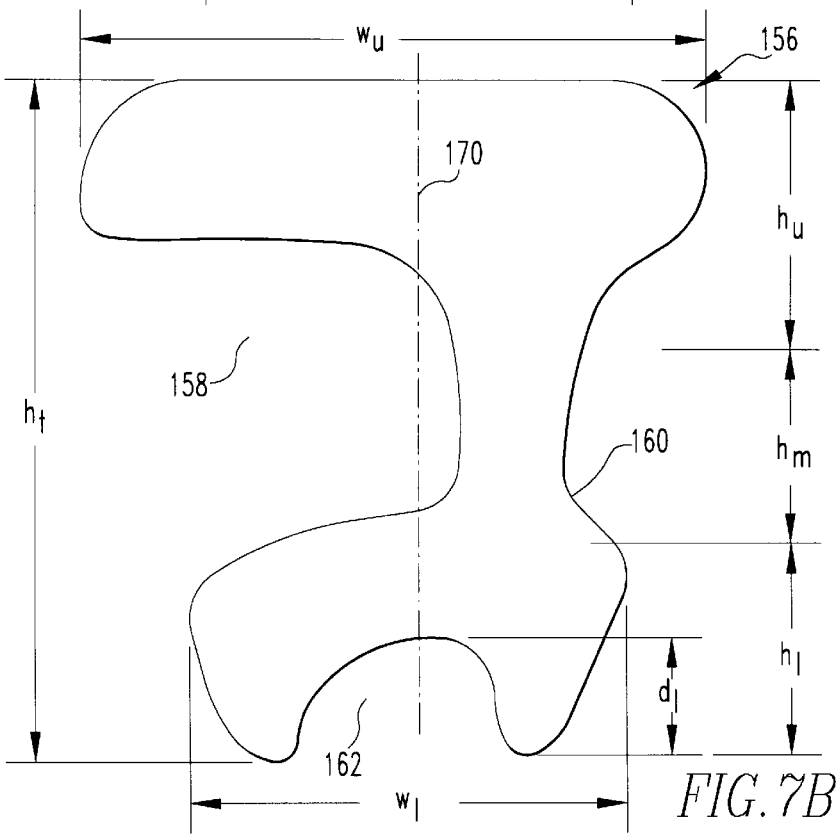

Referring to FIG. 7B-1, another asymmetrical contact which may be used in the plug of the present invention is shown generally at numeral 118. This contact has an upper portion shown generally at 120 which has a front end 122 and a rear end 124 along with a top surface 126. Beneath the upper portion there is an upper front shoulder 128 and an upper rear shoulder 130. Also beneath the upper section there is a substantially vertical middle body portion 132. Beneath this middle body portion there is a lower body portion 134. The lower body portion 134 has a front shoulder 136 and a rear shoulder 138 and a front end 140 and a rear 142. The lower body portion 134 also includes a front tang 144 and a rear tang 146. The asymmetrical contact 118 also includes a front minor recess 148, a rear major recess 150 and a lower recess 152. The contact also has a vertical center line 154, and it will be appreciated that the above described features of this contact are asymmetrically positioned with reference to the center line.

Referring to FIG. 7B-2, another asymmetrical contact shown generally at numeral 156 is essentially a mirror image of the above described contact 118. In particular, it will be appreciated that it has a front major recess 158 and a rear recess 160. It also has a lower recess 152. There is an upper body portion 164, a middle body section 166 and a lower body section 168. Again, it will be appreciated that these sections are essentially identical to the corresponding sections in contact 118. Contact 156 also has a vertical center line 170, and the above described features are asymmetrically arranged with respect to this center line.

Figures 1, 7C:
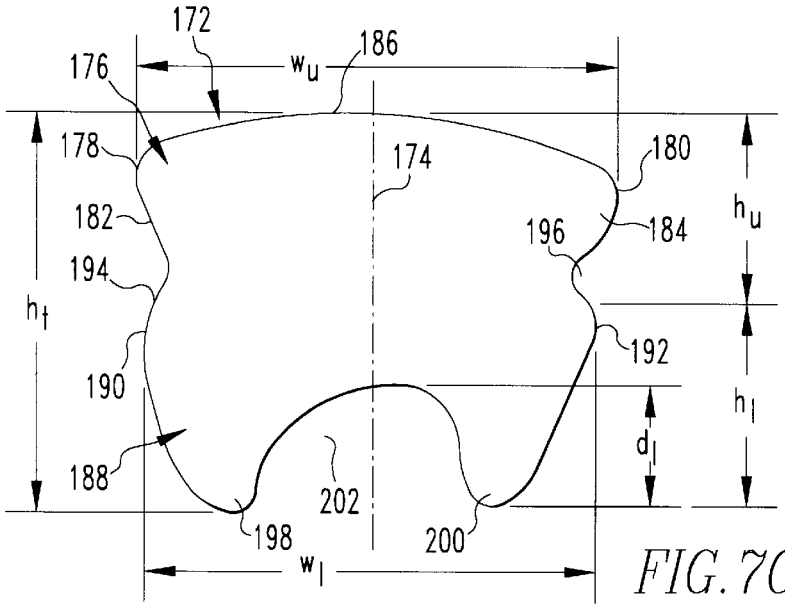
Figures 2, 7C:
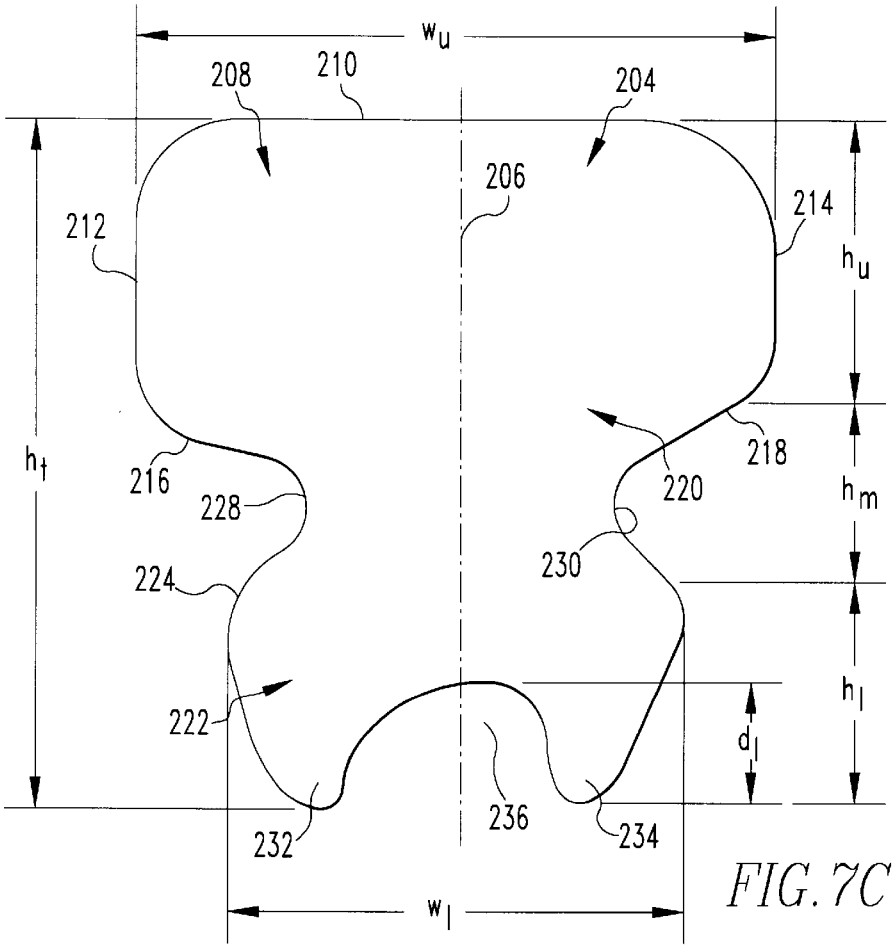

Referring to FIG. 7C-1, symmetrical contact which may be used in the plug of the present invention is shown generally at numeral 172. This contact has a vertical center line 174, and the contact is symmetrical about the center line. The contact has an upper body portion 176 which has a front end 178 and a rear end 180. The upper body portion 176 also has a front shoulder 182 and a rear shoulder 184 as well as a top surface 186. This contact also has a lower section 188 with a front shoulder 190 and a rear shoulder 192 which define respectively the front and rear sides of this lower body portion. The symmetrical contact 172 has a front recess 174 and a rear recess 176 which are the same size. The lower body portion also has a front tang 198 and a rear tang 200 and a lower recess 202.

Referring to FIG. 7C-2, an alternate symmetrical, this contact has a vertical center line 206. This contact has an upper body portion 208 with a top surface 210, a front end 212 and a rear end 214. The upper body portion also has a front shoulder 216 and a rear shoulder 218. Below the upper body portion 208 there is a middle body portion 220. Below the middle body portion there is a lower body portion 222 which has a front shoulder 224 and a rear shoulder 226 which form a front recess 228 and a rear recess 230. The lower body portion also has a front tang 232 and a rear tang 234 as well as a lower recess 236 between the front tang and the rear tang.

EXAMPLE

In modular jacks intended for differential transmission, the signal were sent using two wires. Typical pairs which were used are as follows: positions 1 and 2, positions 3 and 6, positions 4 and 5 and positions 7 and 8. Particularly important and at the same time difficult is to reduce near end cross talk between pairs 1/2 and 3/6 and 3/6 and 4/5. Contacts as described above were made with the dimensions shown in Table I. Thickness for all of these contacts ranged from 0.005"–0.200" with most being from 0.012"–0.015". The material used for these contacts was copper alloy. The contacts were emplaced in plugs (A,B, C, D and E) as is shown in Table II. When using type C1 contacts the wire positions in the plastic body were elevated. Cross talk reduction was achieved by inserting contacts of the same type into the same pair, and contacts of the other type of the same group into the adjacent pairs as is shown in plugs A,B,C and D.

TABLE 1

| | Dimension (inches) | | | | | | |
|---|---|---|---|---|---|---|---|
| Contact | $h_t$ | $h_u$ | $h_m$ | $h_1$ | $w_u$ | $w_1$ | $d_1$ |
| A-1 | 0.145 | 0.060 | 0.040 | 0.023 | 0.1285 | 0.093 | 0.022 |
| A-2 | 0.145 | 0.060 | 0.040 | 0.023 | 0.1285 | 0.093 | 0.022 |
| A-1 | 0.145 | 0.060 | 0.040 | 0.023 | 0.1285 | 0.093 | 0.022 |
| B-2 | 0.145 | 0.060 | 0.040 | 0.023 | 0.1285 | 0.093 | 0.022 |
| C-1 | 0.085 | 0.040 | — | 0.023 | 0.106 | 0.093 | 0.022 |
| C-2 | 0.145 | 0.060 | 0.040 | 0.023 | 0.1285 | 0.093 | 0.022 |

TABLE II

| Plug | 1 | 2 | 3 | 4 | 5 | 6 | 7 | 8 |
|---|---|---|---|---|---|---|---|---|
| A | C2 | C2 | A1 | A2 | A2 | A1 | C2 | C2 |
| B | A1 | A1 | A2 | A1 | A1 | A2 | A1 | A1 |
| C | B1 | B1 | B2 | B1 | B1 | B2 | A1 | A1 |
| D | C1 | C1 | C2 | C1 | C1 | C2 | C1 | C1 |
| E | A1 | A1 | A2 | A1 | A2 | A1 | A2 | A1 |

A plug made as Plug A was tested with CATEGORY 5 modular jacks and subassemblies made by several companies: As shown in Tables III and IV the tests showed unusual and unexpected results in terms of cross talk reduction.

TABLE III

| NEAR END CROSS TALK TEST, (−dB) | | | |
|---|---|---|---|
| | PAIRS 1/2 AND 3/6 | | |
| JACK | PLUG A | OLD PLUG | IMPROVEMENT |
| AMP 558344-1 | 50.5 | 46.0 | 4.5 |
| BERG 72587-0010 | 47.6 | 41.7 | 5.9 |
| ORTRONICS D0070003 | 45.2 | 44.1 | 1.0 |

TABLE IV

| NEAR END CROSS TALK TEST, (−dB) | | | |
|---|---|---|---|
| | PAIRS 4/5 and 3/6 | | |
| JACK | PLUG A | OLD PLUG | IMPROVEMENT |
| AMP 558344-1 | 50.0 | 46.6 | 3.4 |
| BERG 72587-0010 | 57.8 | 56.2 | 1.6 |
| ORTRONICS D0070003 | 50.2 | 48.7 | 1.5 |

It will be appreciated that a modular plug has been provided which results in surprising and unexpected reductions in cross talk.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A modular plug comprising:

(a) an insulative housing comprising a front wall, a rear wall, a top wall, a bottom wall and a pair of lateral walls perpendicularly interposed between said top and bottom walls and wherein there are a plurality of longitudinal terminal receiving slots in the front and top wall and a cable receiving cavity in the rear wall;

(b) a plurality of conductive means wherein each of said conductive means extends from the rear wall of the jack to adjacent one of said terminal receiving slots; and (c) a plurality of metallic contacts wherein each of said contacts is adjacent one of said terminal receiving slots and is connected to one of the conducting means and at least one of said contacts has a different shape from at least one other of said contacts, wherein at least one of the contacts is comprised of a substantially planar blade having a vertical centerline and said blade is substantially symmetrical about its vertical centerline, and at least one of the contacts is comprised of a substantially planar blade having a vertical centerline and said blade is asymmetrical relative to the vertical centerline.

2. The modular plug of claim 1 wherein the substantially planar blade has an upper portion, a middle portion and a lower portion and the upper portion and middle portion each have a width and the width of the upper portion is greater than the width of the middle portion and the lower portion has means for connecting the contact to one of the conducting means.

3. The modular jack of claim 2 wherein the upper portion of the contact has a pair of shoulders extending laterally from both sides thereof for seating said blade in said plug, and an upper surface for making electrical contact with a spring contact of a mating modular jack.

4. The modular jack of claim 2 wherein the conducting means are electrical wires having insulation and the lower portion of the contact includes a pair of tangs for piercing the insulation of an electrical wire located in the modular jack.

5. The modular plug of claim 1 wherein the substantially planar blade has an upper portion, a middle portion and a lower portion and the upper portion and middle portion each have a width and the width of the upper portion is greater than the width of the middle portion and the lower portion has means for connecting the contact to one of the conducting means.

6. The modular jack of claim 5 wherein the upper portion of the contact has a pair of shoulders extending laterally from both sides thereof for seating said blade in said plug, and an upper surface for making electrical contact with a spring contact of a mating modular jack.

7. The modular jack of claim 6 wherein the conducting means are electrical wires having insulation and the lower portion of the contact includes a pair of tangs for piercing the insulation of an electrical wire located in the modular jack.

8. The modular plug of claim 5 wherein top portion of the substantially planar blade has an inner and outer end and the lower portion of said blade has an inner and outer side and the middle portion comprises a vertical section connecting the upper portion and lower portion adjacent its inner side and there is a major recess extending inwardly toward the vertical section from the outer end of the upper portion to the outer side of the lower portion.

9. The modular plug of claim 8 wherein there is a minor recess extending outwardly toward the vertical section in opposed relation to the major recess.

10. The modular plug of claim 8 wherein top portion of the substantially planar blade has an inner and outer end and the lower portion of said blade has an inner and outer side and the middle portion of said blade comprises a vertical section connecting the upper portion and lower portion adjacent its outer side and there is a major recess extending inwardly toward the vertical section from the inner end of the upper portion to the outer side of the lower portion.

11. The modular plug of claim 10 wherein there is a minor recess extending inwardly toward the vertical section in opposed relation to the major.

12. The modular plug of claim 10 wherein there are positions 1, 2, 3, 4, 5, 6, 7 and 8 for the longitudinal slots and there is a symmetrical contact in positions 1, 2, 7 and 8.

13. The modular plug of claim 12 where there is an asymmetrical contact in positions 3, 4, 5 and 6.

14. The modular plug of claim 13 wherein there is an asymmetrical contact having a rearwardly extending major recess in positions 3 and 6.

15. The modular plug of claim 14 wherein there is an asymmetrical contact having a forwardly extending major recess in positions 4 and 5.

16. A metallic contact for use in a modular jack comprising a substantially planar blade having a vertical centerline and said blade is asymmetrical relative to the vertical centerline and has an upper portion, a middle portion and a lower portion and the upper portion and the middle portion each have a width and the width of the upper portion is greater than the width of the middle portion and the lower portion has a conductor engagement means, wherein the upper portion has an inner and outer end and the lower portion has an inner and outer side and the middle portion comprises a narrowed section connecting the upper portion and the lower portion and there is a major recess extending inwardly toward the middle portion from the outer end of the upper portion to the outer side of the lower portion.

17. The metallic contact of claim 16 wherein there is a minor recess extending outwardly toward the vertical section in opposed relation to the major recess.

* * * * *